US011492243B1

(12) United States Patent
Miller

(10) Patent No.: US 11,492,243 B1
(45) Date of Patent: Nov. 8, 2022

(54) BEVERAGE DISPENSER FOR VERTICAL WALL

(71) Applicant: Walter Miller, Camp Hill, PA (US)

(72) Inventor: Walter Miller, Camp Hill, PA (US)

( * ) Notice: Subject to any disclaimer, the term of this patent is extended or adjusted under 35 U.S.C. 154(b) by 0 days.

(21) Appl. No.: 17/328,054

(22) Filed: May 24, 2021

(51) Int. Cl.
*B67D 1/00* (2006.01)

(52) U.S. Cl.
CPC .. *B67D 1/0004* (2013.01); *B67D 2210/00031* (2013.01)

(58) Field of Classification Search
CPC ..... B67D 1/0004; B67D 2210/00031
USPC ..... 222/92, 93, 105, 106, 173, 181.3, 182, 222/183
See application file for complete search history.

(56) References Cited

U.S. PATENT DOCUMENTS 4,850,506 A * 7/1989 Heaps, Jr ..... B65D 77/061 222/105
7,464,567 B1 * 12/2008 Crossley ..... F25D 31/006 222/129
8,276,806 B2 * 10/2012 Burke ..... B65D 77/062 229/122
2007/0039974 A1 * 2/2007 Lloyd ..... B65D 83/0072 206/229
2011/0068126 A1 * 3/2011 Walter ..... B67D 3/0029 222/146.1
2015/0076175 A1 * 3/2015 Smith ..... A47J 41/0083 222/181.3

* cited by examiner

*Primary Examiner* — Lien M Ngo
(74) *Attorney, Agent, or Firm* — Gulf Coast Intellectual Property Group

(57) ABSTRACT

A beverage dispenser configured to be mounted to a vertical wall wherein the beverage dispenser provides dispensing of a beverage while suspended on the wall. The present invention includes a support frame wherein the support frame defines the peripheral edges of the shape of the support frame. The support frame includes a central aperture surrounded by a plurality of support members. A cover member is secured to the front side of the support frame so as to cover the central aperture. A bladder is suspendedly mounted within the central aperture of the support frame and extends downward from the upper end to the lower end of the support frame. The bladder includes a nozzle that is journaled through a hole in the cover member so as to provide dispensing of a beverage subsequent the beverage dispenser being secured to a wall. The cover member includes decorative indicia.

2 Claims, 3 Drawing Sheets

BEVERAGE DISPENSER FOR VERTICAL WALL

FIELD OF THE INVENTION

The present invention relates generally to beverage containers and assemblies, more specifically but not by way of limitation, a beverage dispenser assembly that is configured to suspend a beverage bladder on a vertical wall wherein the present invention further includes a support frame and cover member that provides an aesthetically desirable appearance.

BACKGROUND

Wine and wine like beverages have been around for thousands of years. Wine has been consumed for generations and is often consumed with a meal or can be consumed at other times. Conventional wine packaging typically is performed in bottles wherein the bottles range in size from small single serving bottle to large double magnum bottles. While bottles have proven to be an effective vessel there are other types of beverage containers that are being utilized to provide a more economical and even more travel friendly container. One relatively newer type of packaging for wine is boxed wine. Boxed wine provides wine in larger quantities and can be more economical for wine producers. These type of alternative packaging provides a technique to offer a more cost effective and easier to handle type of package making wine more desirable to drink for particular markets.

Another vessel that is being utilized to package wine are plastic bladders. These plastic bladders can be disposed internally to a box or similar structure or can be provided by themselves. The plastic bladders offer a convenient way to package wine and provide the airtight packaging that is desirable to maintain the quality of the wine. While beverage bladders can be provided in containers to be positioned for dispensing the beverage there are options that are currently not provided by existing technology in the field.

It is intended within the scope of the present invention to provide a beverage mount for a beverage bladder wherein the beverage bladder can be coupled to the present invention and suspended on a vertical wall so as to be positioned for a user to dispense the beverage disposed in the bladder.

SUMMARY OF THE INVENTION

It is the object of the present invention to provide a beverage bladder mounting apparatus that is configured to receive a bladder and mount on a vertical wall wherein the present invention includes a support frame.

Another object of the present invention is to provide a beverage dispenser operable to be hung on a wall wherein the support frame includes a plurality of support members that are secured to each other so as to define a peripheral edge around an opening of the support frame.

A further object of the present invention is to provide a beverage bladder mounting apparatus that is configured to receive a bladder and mount on a vertical wall wherein the support frame includes a first side and a second side.

Still another object of the present invention is to provide a beverage dispenser operable to be hung on a wall that further includes a cover member wherein the cover member is secured to the first side of the support frame and extends across the opening of the support frame.

An additional object of the present invention is to provide a beverage bladder mounting apparatus that is configured to receive a bladder and mount on a vertical wall wherein the cover member includes an aperture.

Yet a further object of the present invention is to provide a beverage dispenser operable to be hung on a wall that further includes a cover member wherein the support frame includes an upper support member wherein the upper support member has a bladder retention member secured thereto.

Another object of the present invention is to provide a beverage bladder mounting apparatus that is configured to receive a bladder and mount on a vertical wall wherein the bladder retention member is configured to releasably secure a beverage bladder therein.

An alternate object of the present invention is to provide a beverage dispenser operable to be hung on a wall wherein the support frame further includes bladder securing straps extending across the opening of the support frame.

An alternative objective of the present invention is to provide a beverage bladder mounting apparatus that is configured to receive a bladder and mount on a vertical wall wherein the present invention includes a bladder having a spout secured to the bottom end thereof.

Another object of the present invention is to provide a beverage dispenser operable to be hung on a wall wherein the cover member has an exterior surface having a decorative indicia imprinted thereon.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
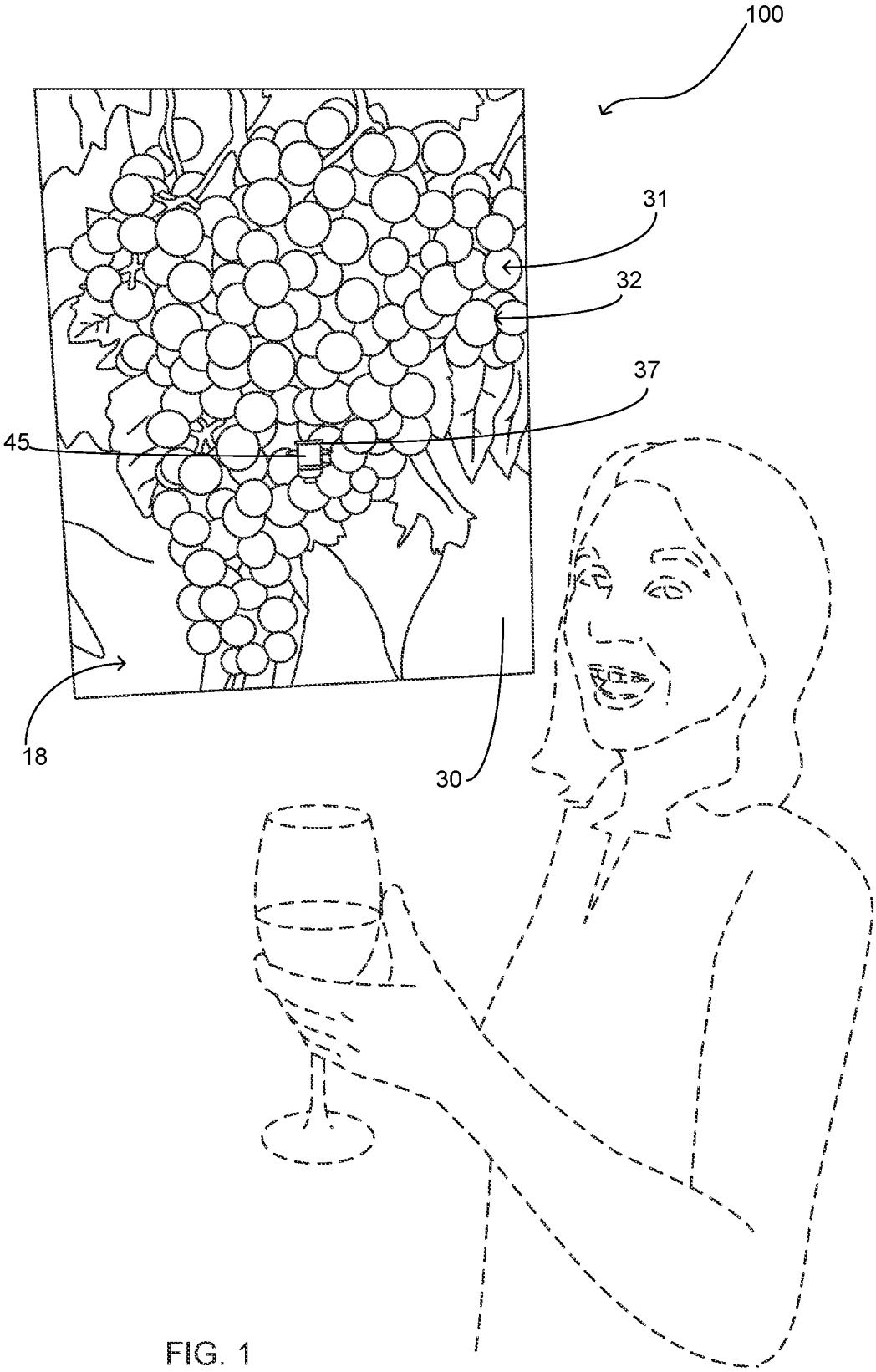
FIG. 1 is a front view of an embodiment of the present invention.

References now to the drawings submitted herewith, wherein various elements depicted therein are not necessarily drawn to scale and wherein through the views and figures like elements are referenced with identical reference numerals, there is illustrated a beverage dispenser 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Now referring to the Drawings submitted as a part hereof, the beverage dispenser 100 includes a support frame 10. The support frame 10 is comprised of a plurality of support members 15. The support frame 10 is manufactured from a rigid lightweight material such as but to limited to wood or metal. While the preferred embodiment illustrated herein is rectangular in shape and has four support members 15, it should be understood within the scope of the present invention that the support frame 10 could be provided in alternate shapes and sizes and be comprised of either a single or plurality of support members 15. The support frame 10 includes a front side 18 and a rear side 19 wherein the rear side 19 will be adjacent the wall on which the beverage dispenser 100 is mounted.

The support frame 10 includes a central aperture 20 wherein the central aperture 20 is encircled by the support frame 10. The thickness of the support frame 10 and the central aperture 20 provides the suitable storage space 22 for the bladder 40 as will be further discussed herein. The central aperture 20 is covered by the cover member 30 wherein the cover member 30 is secured to the front side 18 of the support frame 10. The cover member 30 is secured to the support frame 10 utilizing suitable techniques such as but not limited to mechanical fasteners and/or chemical adhesion. The cover member 30 is manufactured from a durable material such as but not limited to nylon. The cover member 30 extends completely across the central aperture 20 and provides complete coverage of the support frame 10 in order to conceal the bladder 40. The cover member 30 includes an exterior surface 31 wherein the exterior surface 31 further includes decorative indicia 32 imprinted thereon. The cover member 30 and decorative indicia 32 function to provide an interior design element for a room. It should be understood within the scope of the present invention that the indicia 32 could be various alternate designs and colors.

The cover member 30 includes a slit 37 formed therein proximate the lower end thereof. The slit 37 provides a technique for the nozzle 45 of the bladder 40 to be inserted through the cover member 30. Nozzle 45 is integrally formed with bladder 40 and provides dispensing of the liquid disposed in the bladder 40 ensuing the beverage container mount 100 being mounted to a wall. It should be understood within the scope of the present invention that the nozzle 45 could be provided in alternate forms and achieve the desired objective discussed herein. The bladder 40 is configured to receive and store therein a liquid such as but not limited to wine. The bladder 40 includes cap member 49 which facilitates re-filling of the bladder 40 and nozzle 45 wherein the nozzle 45 provides dispensing of the liquid. The bladder 40 is manufactured from a suitable flexible material such as but not limited to plastic. It should be understood within the scope of the present invention that the bladder 40 could be provided in alternate shapes and sizes.

Figure 2:
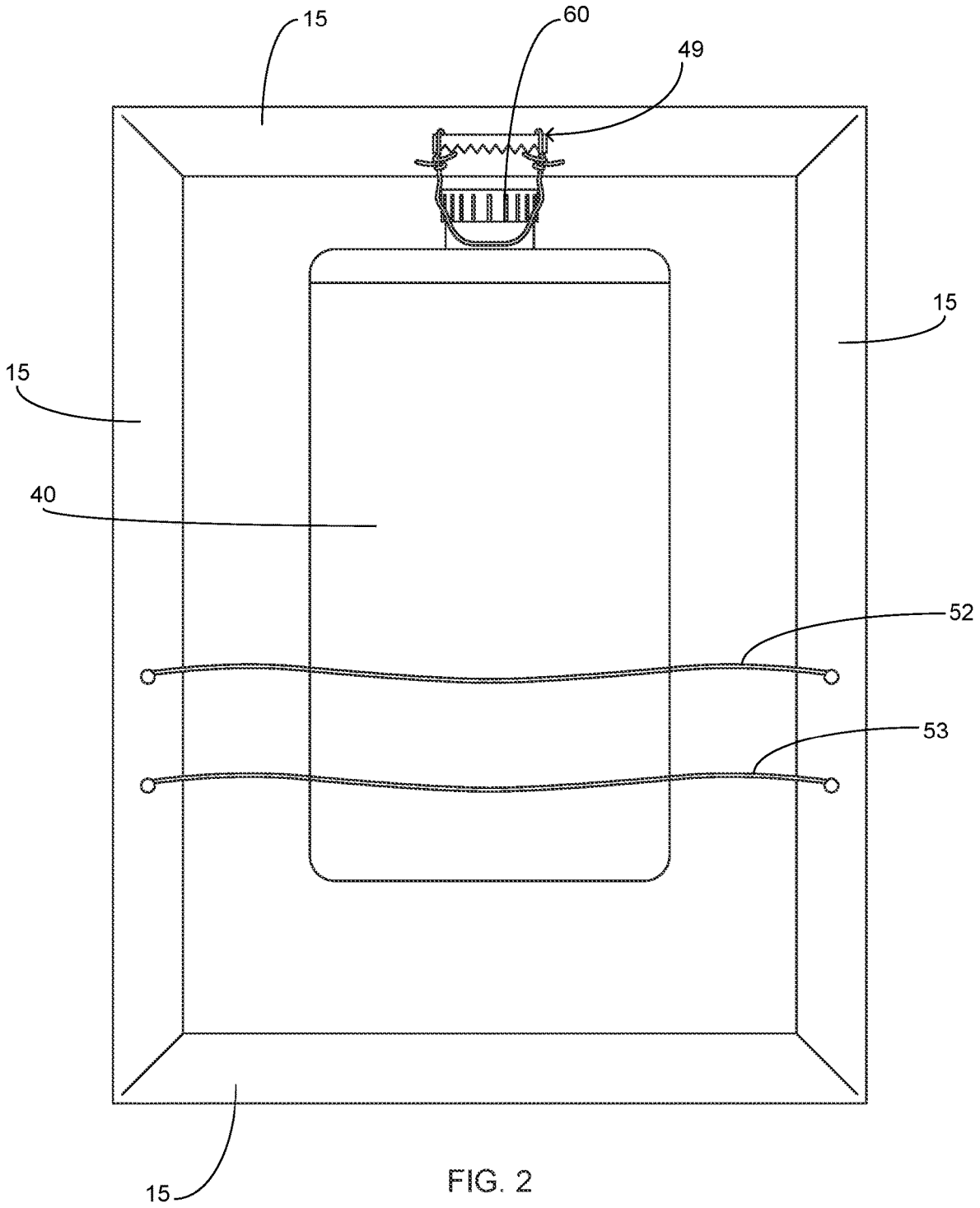
FIG. 2 is a rear view of an embodiment of the present invention.

As illustrated herein in FIG. 2 herein, the support frame 10 includes a first securing member 52 and second securing member 53 mounted to the support frame 10 extending across the central aperture 20. The first securing member 52 and second securing member 53 are configured to assist in the maintenance of the position of the bladder 40 subsequent the securing thereof to the support frame 10. The first securing member 52 and second securing member 53 are manufactured from a suitable material such as but not limited to wire. While a first securing member 52 and second securing member 53 are illustrated and discussed herein it is contemplated within the scope of the present invention that the beverage dispenser 100 could employ alternate elements to secure the bladder 40 in position within the support frame 10.

It is contemplated within the scope of the present invention that the bladder 40 could be suspendedly secured within the support frame 10 with various embodiments of the bladder retention member 60. As illustrated herein in FIG. 2, the bladder retention member 60 includes a resilient wire member that is configured to be releasably secured to the cap member 49 of the bladder 40.

Figure 3:
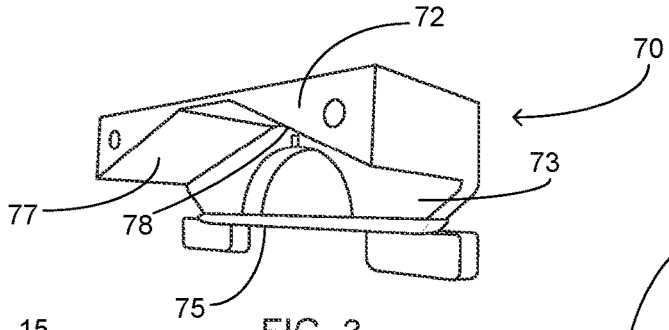
FIG. 3 is a perspective view of a bladder retention member of the present invention.
Figure 4:
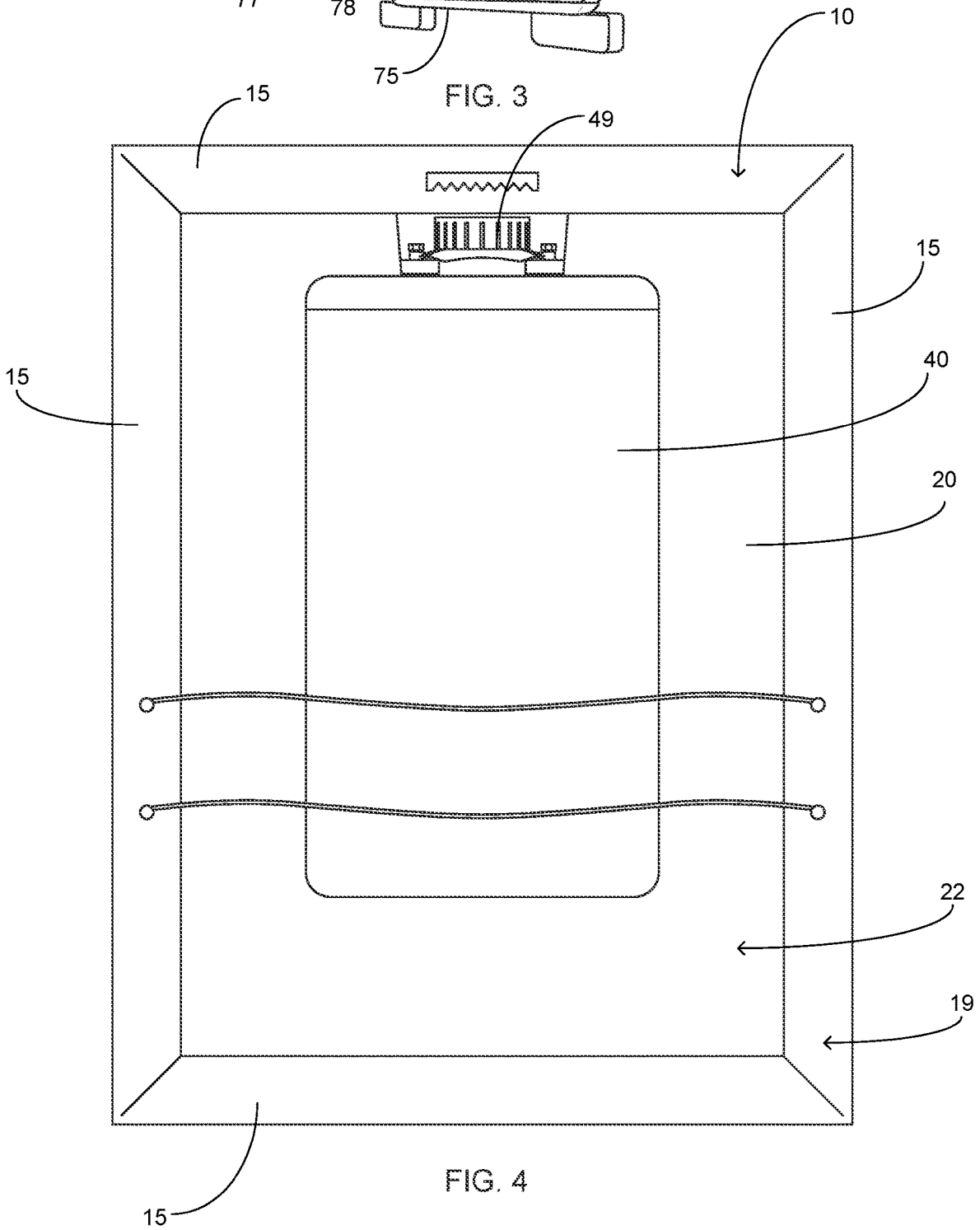
FIG. 4 is a rear view of an embodiment of the present invention with the preferred bladder retention member.

FIG. 3 illustrates herein a preferred embodiment of the bladder retention member 70. The bladder retention member 70 includes a body 71 wherein the body is manufactured from a durable rigid material such as but not limited to plastic. The body 71 includes a top support member 72 being integrally formed with a rear support member 73. The top support member 72 is contiguous with the upper end of the rear support member 73 and extends outward therefrom. The rear support member 73 includes a lower end wherein the lower end has contiguously formed therewith lower support member 75. The top support member 72 includes an inner surface 76 wherein the inner surface 76 includes opposing angular sections 77,78. The angular sections 77,78 work in conjunction with the lower support member 75 to releasably secure the cap member 49 so as to suspendedly mount the bladder 40 within the support frame 10.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding description is, therefore, not intended to be limited to the specific forms set forth herein, but on the contrary, it is intended to cover such alternatives, modifications, and equivalents, as can be reasonably included within the spirit and scope of the invention.

What is claimed is:

1. A beverage dispenser configured to be suspendedly mounted on a vertical wall surface wherein the beverage dispenser comprises:

a support frame, said support frame being manufactured from a lightweight rigid material, said support frame having a plurality of support members, said plurality of support members defining a rectangular shape of the support frame, said support frame having a central aperture defined by said plurality of support members, said central aperture extending substantially across said support frame providing an opening therethrough, said support frame having a front side and a rear side, said support frame having an upper end and a lower end;

a cover member, said cover member being secured across said front side of said support frame, said cover member completely covering said central aperture, said cover member having an exterior surface;

a bladder, said bladder being mounted to said support frame, said bladder being configured to receive store and dispense a liquid, said bladder having an upper end and a lower end, said bladder having a cap member proximate said upper end, said bladder having a nozzle proximate said lower end, and a bladder retention member, said bladder retention member being secured to said frame proximate said upper end thereof, said bladder retention member configured to be releasably secured to said bladder proximate said cap member, wherein said bladder retention member further includes a rear support member, said rear support member having an upper end and a lower end, said bladder retention member further including a top support member, said top support member being contiguous with said upper end of said rear support member and extending perpendicularly outward therefrom, wherein said top support member includes an inner surface, said inner surface having opposing angular sections operable to assist in engagement of the cap member of the bladder; and at least one securing member, said at least one securing member being secured to said support frame on said rear side thereof, said at least one securing member extending across said central aperture.

2. The beverage dispenser configured to be suspendedly mounted on a vertical wall surface as recited in claim 1, wherein said exterior surface of said cover member includes decorative indicia imprinted on the exterior surface thereof.

* * * * *